United States Patent [19]

Simpson

[11] 4,084,805

[45] Apr. 18, 1978

[54] SHEET HANDLING DEVICE PARTICULARLY USEFUL AS LEDGER FEEDER AND STACKER FOR ACCOUNTING MACHINES

[75] Inventor: Adam Simpson, Uddington, Scotland

[73] Assignee: Burroughs Corporation, Detroit, Mich.

[21] Appl. No.: 732,841

[22] Filed: Oct. 18, 1976

[30] Foreign Application Priority Data

Nov. 6, 1975 United Kingdom ..... 45988/75

[51] Int. Cl.[2] ..... B65H 1/28; B65H 29/60; B65H 29/44

[52] U.S. Cl. ..... 271/4; 197/128; 197/130; 271/9; 271/64; 271/181; 271/DIG. 9

[58] Field of Search ..... 271/4, 9, 64, DIG. 9, 271/181, 180, 177, 3; 214/7; 197/130, 128, 127 R

[56] References Cited

U.S. PATENT DOCUMENTS

| | | | |
|---|---|---|---|
| 1,310,433 | 7/1919 | Powers | 271/64 X |
| 3,112,926 | 12/1963 | Stuckens | 271/64 |
| 3,669,444 | 6/1972 | Van Namen | 271/DIG. 9 X |
| 3,698,706 | 10/1972 | Mihojevich et al. | 271/9 |
| 3,756,586 | 9/1973 | Craft | 271/9 |
| 3,776,545 | 12/1973 | White | 271/4 |

*Primary Examiner*—Bruce H. Stoner, Jr.

*Attorney, Agent, or Firm*—Dale V. Gaudier; Benjamin J. Barish; Kevin R. Peterson

[57] ABSTRACT

Sheet handling device useful for handling sheets to be processed by data processing apparatus, such as a ledger accounting machine. The device includes a main hopper compartment into which documents to be processed are manually deposited, an auxiliary hopper compartment for blank documents, a main stacker compartment into which processed documents are automatically advanced, a stacker ram in the main stacker compartment to compact documents as they are stacked, an auxiliary stacker compartment for accumulating completely filled processed documents for subsequent manual removal, and a document hold station for temporarily storing partially processed documents pending the generation of data to be recorded in summary thereon. Feed rollers are provided for selectively feeding documents to be processed and blank documents from the main and auxiliary hopper compartments, respectively, to the processing station of the accounting machine, for selectively advancing partially processed documents from the processing station to the document hold station, for recallably feeding partially processed documents from the document hold station to the processing station to complete the processing thereof, and for selectively feeding fully processed documents and filled documents to the main stacker compartment and the auxiliary stacker compartment, respectively.

11 Claims, 10 Drawing Figures

87
19
25
155'
155
153
149
151
89
137
129
90

SHEET HANDLING DEVICE PARTICULARLY USEFUL AS LEDGER FEEDER AND STACKER FOR ACCOUNTING MACHINES

BACKGROUND OF THE INVENTION

Field of the Invention

The present invention relates to sheet handling devices. The invention is particularly suitable for use in a ledger feeder and stacker for accounting machines, such as illustrated in United Kingdom patent specification No. 1,402,374 published Aug. 6, 1975 assigned to the same assignee as the present application, and it is therefore described below with respect to that use.

U.K. patent specification No. 1,402,374 describes a ledger feeder and stacker for use with an accounting or other data processing machine which enables a quantity of ledgers to be deposited by the operator into a hopper compartment and then to be individually processed in an efficient manner. From the hopper compartment the individual ledgers are automatically fed to the processing station in the accounting machine for updating, and are then automatically advanced from the processing station to a stacker compartment in the ledger handling device for subsequent removal at periodic intervals by the operator. The disclosed device further provides a ledger "hold" position or station for the temporary storage or "parking" of partially processed ledgers. This feature enables a partially processed ledger to be automatically advanced from the processing station in the accounting machine to the hold station in the ledger feeder and stacker, and then to be automatically recalled from the hold station back to the processing station for the completion of its processing by the accounting machine, after which it may be advanced to the stacker compartment.

SUMMARY OF THE INVENTION

An object of the present invention is to provide a number of improvements to sheet handling devices in general and to the ledger feeder and stacker of the above-cited U.K. patent specification in particular.

According to one aspect of the present invention, there is provided a sheet handling device for handling sheets to be processed by a data processing machine, comprising: a main hopper compartment for receiving sheets to be processed; a main stacker compartment for receiving sheets after their processing; sheet feeding means for feeding sheets from the hopper compartment through a first path leading to the data processing machine; sheet stacking means for moving the sheets, after their processing by the data processing machine, through a second path leading from the data processing machine to the stacker compartment; an auxiliary hopper compartment for receiving additional sheets to be processed; auxiliary feed means for feeding sheets from the auxiliary hopper compartment through said first path to the data processing machine; and control means for selectively actuating said sheet feeding means or said auxiliary feeding means to feed a sheet from the main hopper compartment or the auxiliary hopper compartment through the first path to the data processing machine for processing thereof.

According to another aspect of the invention, the sheet handling device further includes an auxiliary stacker compartment; a gate in said second path; and means for actuating said gate to direct the sheets either into the main stacker compartment or into the auxiliary stacker compartment.

Devices constructed in accordance with the above features of the invention provide a number of advantages particularly when embodied in a ledger feeder and stacker of the type described in the above-cited U.K. patent specification. One important advantage in such an application is that the auxiliary hopper and stacker compartments may be used for conveniently separating completely-filled ledgers and for substituting new blank ledgers therefor. Thus, the auxiliary hopper compartment could be used for holding a supply of blank ledger cards; and when a ledger from the normal stack is completely filled as it leaves the accounting machine, it would be directed not to the main stacker compartment but rather to the auxiliary stacker compartment, and a new blank ledger would then be fed from the auxiliary hopper compartment to the data processing machine and, after its processing, to the main stacker compartment. The auxiliary stacker compartment would thus accumulate filled ledgers which could be periodically removed, each filled ledger being replaced in the stack by a new blank card supplied from the auxiliary hopper compartment.

According to a further aspect of the invention, there is provided a sheet handling device for handling sheets to be processed by a data processing machine, comprising: a main hopper compartment for receiving sheets to be processed; a main stacker compartment for receiving sheets after their processing; sheet feeding means for feeding the sheets from the main hopper compartment through a first path leading to the data processing machine; sheet feeding means for feeding the sheets, after their processing by the data processing machine, through a second path leading from the data processing machine to the stacker compartment; a stacker ram in the main stacker compartment; and ram drive means for moving the stacker ram away from the stack of sheets in the main stacker compartment during the operation of the stacking means, and against said stack to compact same during the operation of the sheet feeding means.

This feature of the invention substantially increases the capacity of the device, since the stack is compacted by the ram after each stacking operation so as to maximize the number of cards that can be held within a limited space.

According to a further aspect of the invention, there is provided a sheet handling device for handling sheets to be processed by a data processing machine, comprising: a main hopper compartment for receiving sheets to be processed; a main stacker compartment for receiving sheets after their processing; sheet feeding means for feeding sheets from the main hopper compartment through a first path leading to the data processing machine; sheet stacking means for moving the sheets, after their processing by the data processing machine, through a second path leading from the data processing machine to the stacker compartment; said second path including a hold station for temporarily holding processed sheets being fed from the data processing machine; a hold station deflector in said second path, said deflector being actuated when a sheet is in the hold station to prevent another sheet leaving the data processing machine from passing into said second path; and control means for selectively controlling said sheet stacking means to terminate the operation thereof when the processed card has reached the hold station. This aspect is particularly advantageous for use when a partially-processed ledger is being temporarily held in the hold station for subsequent processing. It enables a second ledger to be manually fed into the handling device for processing by the accounting machine, and so long as the first ledger is in the hold station, the second ledger will be automatically blocked from passing to a stacker compartment after processing, but will be automatically returned to the operator.

BRIEF DESCRIPTION OF THE DRAWINGS

The invention is herein described, somewhat diagrammatically and by way of example only, with reference to a preferred embodiment, in the form of a ledger feeder and stacker device of the type described in the above-cited U.K. patent specification, as illustrated in the accompanying drawings, wherein.

DESCRIPTION OF THE PREFERRED EMBODIMENTS

Figure 1:
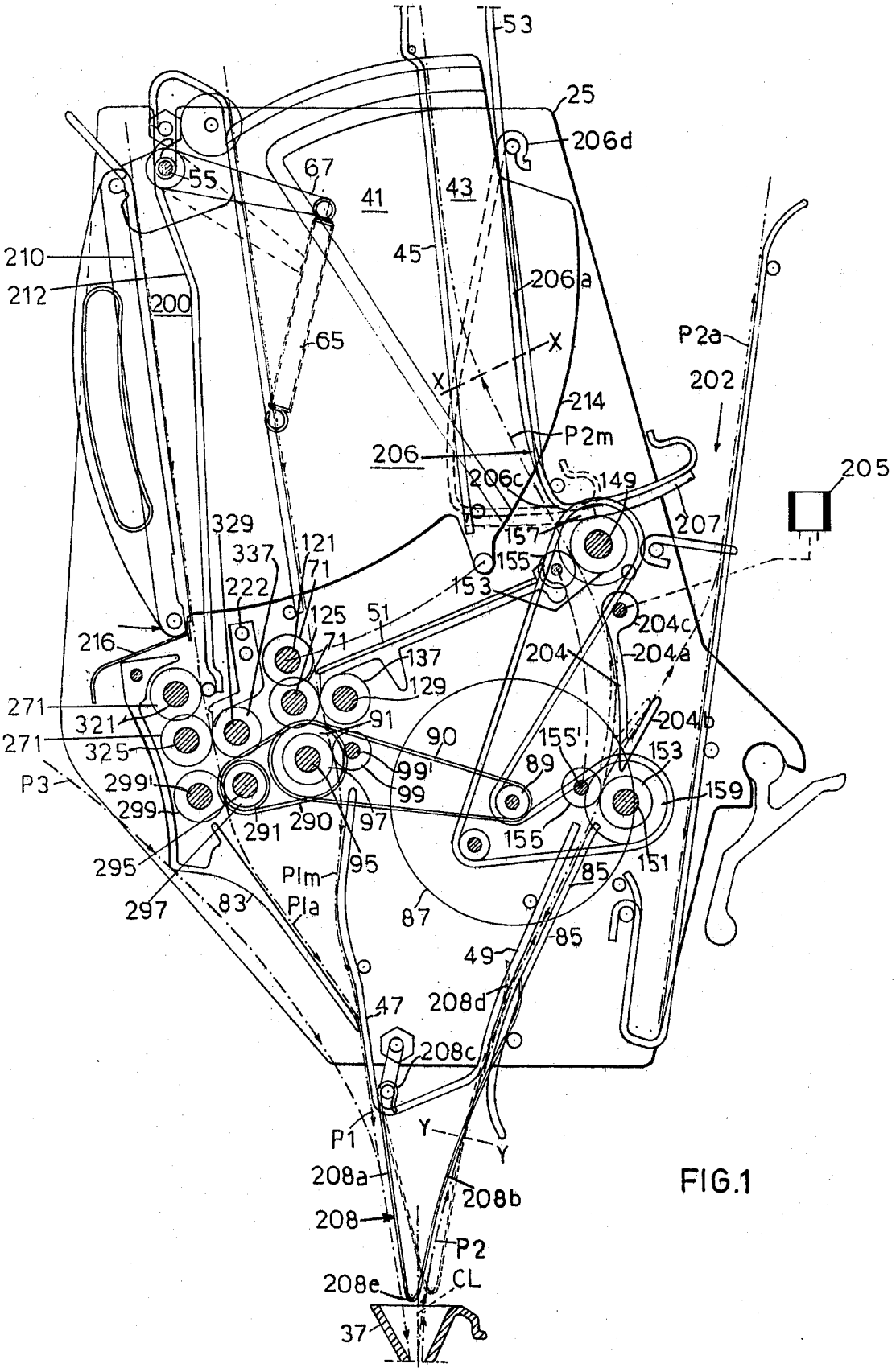
FIG. 1 is a side elevational view illustrating the main elements of the novel ledger feeder and stacker device constructed in accordance with the invention.

In order to facilitate an understanding of the illustrated embodiment of the invention, those parts which generally correspond to parts in the ledger feeder and stacker described in the above-mentioned U.K patent specification No. 1,402,374 are identified by the same reference numerals as in that specification; and the other parts are identified by reference numerals beginning with "200." For the sake of brevity, the present application illustrates only those parts of the feeder and stacker device which are deemed essential to an understanding of the present invention, further details of the structure and operation of that device being available by reference to the complete description in that specification.

With reference first to the general arrangement of the ledger feeder and stacker illustrated in the drawings, it includes a pair of side plates 25 secured together by support shafts 19 (FIG. 2*a*) and defining between them a hopper compartment 41 (FIG. 1) and a stacker compartment 43, the two compartments having a common floor 51 and being separated by a pivotably mounted divider 45. Hopper compartment 41 (hereinafter referred to as the main hopper compartment) is adapted to receive a plurality of ledgers (main hopper ledgers MHL, FIG. 1*a*), to be processed by the accounting machine the throat of which is shown at 37 in FIG. 1, to which the feeder stacker is attached; and stacker compartment 43 (hereinafter referred to as the main stacker compartment) is adapted to receive the ledgers (main stacker ledgers MSL, FIG. 1*a*) in stacked formation after they have been processed by the accounting machine.

The illustrated device further includes an auxiliary hopper compartment 200 forwardly (leftwardly, as viewed in FIGS. 1 and 1*a*) of the main hopper compartment 41 and adapted to receive a plurality of blank ledgers (auxiliary hopper ledgers AHL, FIG. 1*a*), and an auxiliary stacker compartment 202 rearwardly (rightwardly, as viewed in FIGS. 1 and 1*a*) of the main stacker compartment 43 and adapted to receive selected (e.g., completely-filled) ledgers (auxiliary stacker ledgers ASL, FIG. 1*a*) after their processing by the accounting machine.

Separate feeding means are provided for selectively feeding the ledgers either from the main hopper compartment 41 or from the auxiliary hopper compartment 200 to the accounting machine. The feeding means for the ledgers in the main hopper compartment 41 is basicly the same as described in the above-cited U.K. patent specification, and this feeding means is substantially duplicated for feeding the ledgers from the auxiliary hopper compartment 200, the two feeding means being selectively actuated according to whether a ledger is to be fed from the main hopper compartment 41 or from the auxiliary hopper compartment 200.

A ledger from either compartment is fed through a first path (indicated by arrow P1 FIG. 1) defined by a guide member 47 to the injection-ejection throat 37 of the accounting machine for processing thereby. If a ledger MHL is fed from the main hopper compartment 41, it first passes through branch P1*m* of path P1, this branch being defined by the upper end of guide member 47; and if a ledger AHL is fed from the auxiliary hopper compartment 200 it first passes through branch P1*a* of path P1, this branch being defined by the inner surface of an extrusion 83. Both branches come together at the lower tip of the extrusion 83 to continue along path P1 to the accounting machine throat 37.

Figure 1A:
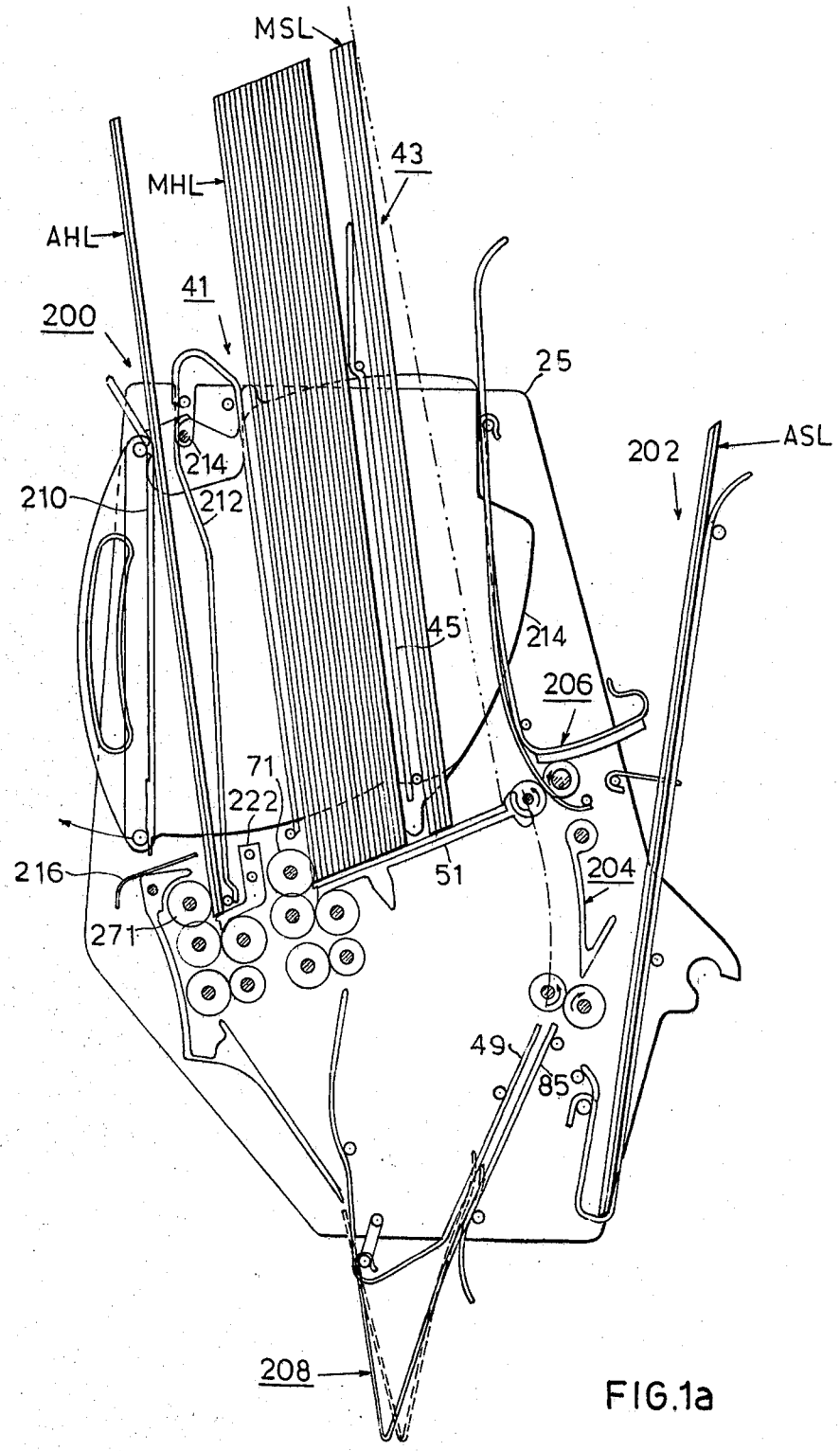
FIG. 1*a* is a view generally corresponding to that of FIG. 1 but showing the feeder in condition for operation and the various compartments loaded with their respective ledger cards.
Figures 2, 2A, 2B:
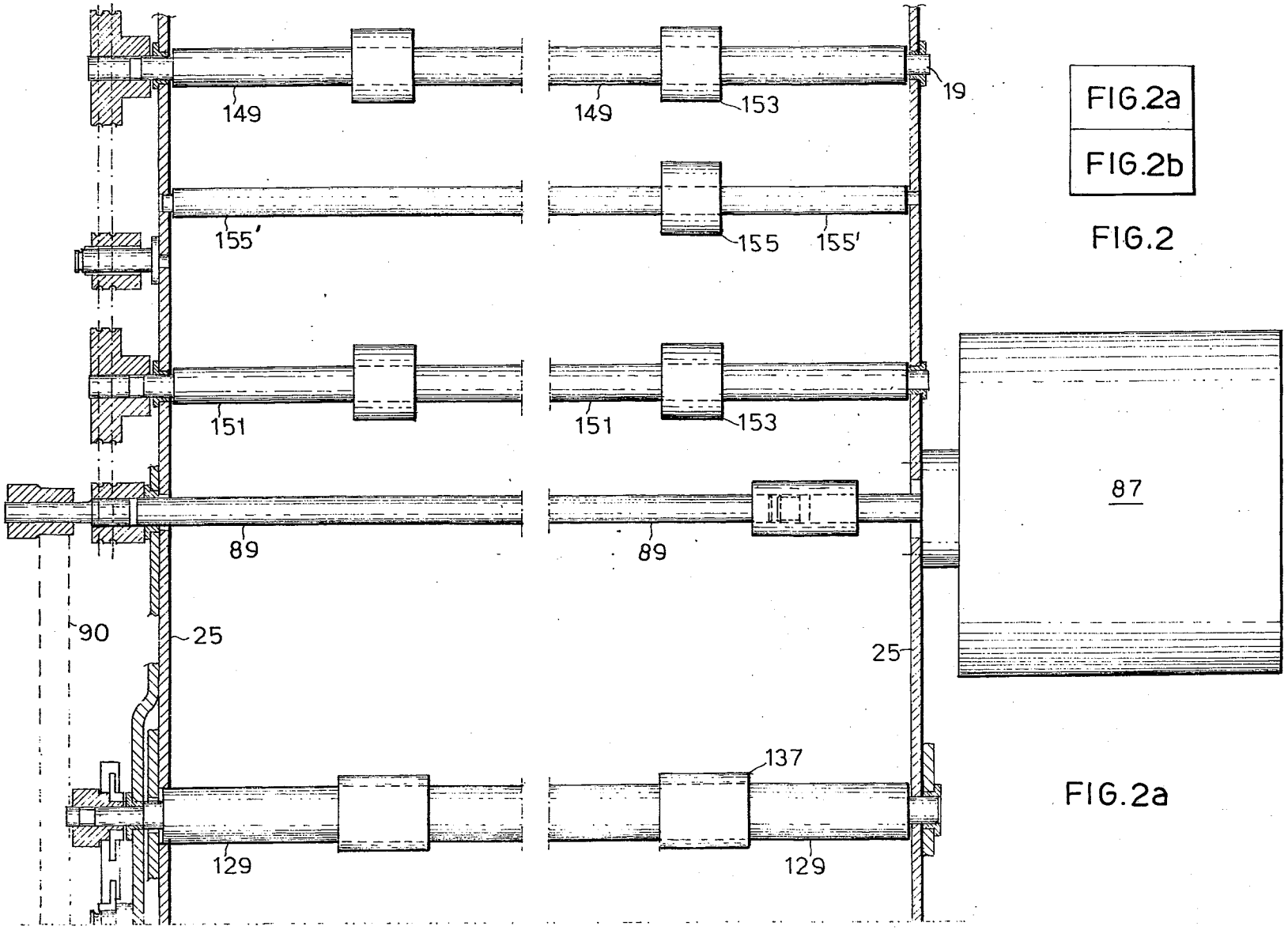
FIG. 2 shows diagrammatically the arrangement of the drive elements illustrated in FIGS. 2*a* and 2*b*.
FIG. 2*a* is a front view illustrating the main elements of the sheet stacking drive of the invention.
FIG. 2*b* is a front view illustrating the main elements of the sheet feeding drive of the invention.
Figure 2B:
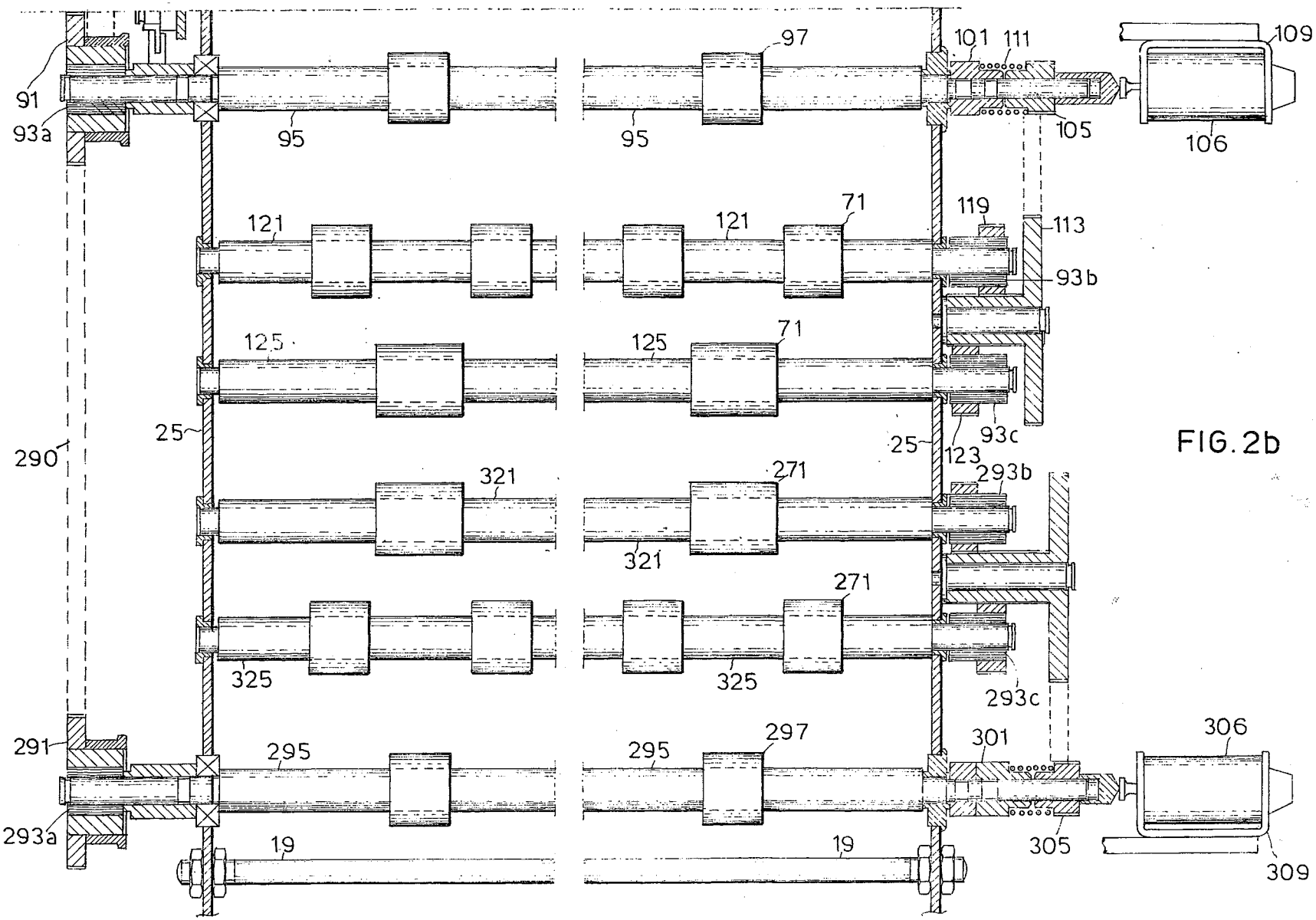

After the ledger has been processed by the accounting machine, it is fed through a second path (indicated by arrow P2) to either the main stacker compartment 43 or to the auxiliary stacker compartment 202, this being determined by the position of a deflector gate 204 which is controlled by an actuator, schematically shown as a solenoid 205 in FIG. 1. In the full-line position of deflector gate 204 as illustrated in FIG. 1, the ledger is fed between a pair of guide members 49 and 85, and is deflected by the front (left, FIG. 1) face of gate 204 so as to pass along branch P2m into the main stacker compartment 43. On the other hand, if deflector gate 204 has been actuated so as to assume the broken-line position illustrated in FIG. 1, the ledger is deflected by the rear (right, FIG. 1) face of the gate to move along branch P2a into the auxiliary stacker compartment 202. The structure and operation of deflector gate 204 are more particularly described below.

The feeder stacker device illustrated in FIG. 1 further includes a stacker ram 206 within the main stacker compartment 43. This stacker ram acts to compact the stack of ledgers within that compartment, thereby increasing the capacity of the device. This is also described more particularly below.

As in the feeder-stacker of the above-cited U.K. patent specification, the device illustrated in FIG. 1 also provides a hold position or station for the temporary storage or parking of a partially-processed ledger, the ledger being subsequently recalled back to the accounting machine for the completion of its processing. The device of the present invention includes a hold station deflector 208 which, when a ledger is in the hold station, is actuated by the ledger itself to prevent another ledger leaving the accounting machine from passing into the second path P2, thereby forcing such other ledger to be ejected back to the operator. The structure and operation of the hold station deflector 208 are also more particularly described below.

With reference now to the specific construction of the device illustrated in the drawings, the auxiliary hopper compartment 200 is defined by a front wall 210 and a rear wall 212, both made of an open wire network as are most of the other walls of the device. Front wall 210 and the previously-mentioned divider wall 45 form a rigid frame with a pair of side walls 214. This frame receives the ledgers and is fixed at its upper end to a pivotal shaft 55. The frame is spring-urged to the position illustrated in FIG. 1*a* by a coil spring 65 connected at one end to an arm 67 fixed to pivotal shaft 55, and at the opposite end to the fixed side plates 25, but may be retained in the position illustrated in FIG. 1 by a latch 216 engaging the lower end of front wall 210. In the latched position illustrated in FIG. 1, front wall 210 acts as a guide face for new cards being inserted into the auxiliary hopper compartment 200; and in the unlatched position illustrated in FIG. 1*a*, the frame is spring-urged forwardly moving both the rear wall 212 of the auxiliary hopper compartment 200, and wall 45 constituting the rear wall of the main hopper compartment 41, towards the feed rollers for the ledgers in the respective compartments to force the ledgers against their respective feed rollers in order to start the feeding of the ledgers.

The floor 51 common to the main hopper compartment 41 and the stacker compartment 43 is in the form of an extension member which guides the lower ends of the ledgers within the main hopper compartment 41 to be picked up and fed by their respective feeding means. Another extrusion member 222 guides the lower ends of the ledgers in the auxiliary hopper compartment 200 to be picked-up and fed by their respective feeding means.

The feeding means for the ledgers within the main hopper compartment 41 is essentially the same as described in the above-cited U.K. patent specification. It includes a reversible motor 87 fixed to the right side frame 25 (FIG. 2*a*), the drive shaft 89 of which motor extends through both side frames and provides the power for driving the ledger feed means and the ledger stacking means. The end of motor shaft 89 extending through the left side frame 25 is connected via belt 90 to a pinch-roller toothed-pulley 91 which in turn is connected by a one-way roller clutch 93*a* (FIG. 2*b*) to a pinch-roller shaft 95. Shaft 95 is journaled within the two side frames 25 and fixedly carries a plurality of pinch-rollers 97, which in combination with a like number of cooperating idle-rollers 99 mounted on a flexure shaft 99' (FIG. 1), feed the ledgers along branch path P1*m* from the main hopper compartment 41 to the accounting machine throat 37.

The end of shaft 95 carries a clutch member 101 (FIG. 2*b*) cooperable with another clutch member 105 which is actuated by a solenoid 106 supported by a bracket 109 fixed to the right side frame 25. Clutch member 105 includes a gear face which is coupled, via gears 113, 119 and a one-way roller clutch 93*b*, to an upper feed shaft 121 carrying a plurality of upper feed-rollers 71, and via gears 113, 123 and another one-way roller clutch 93*c* to a lower feed shaft 125 also carrying a plurality of feed-rollers 71. The foregoing elements are shown only diagrammatically in FIGS. 2*a*, 2*b*, as their detailed structural arrangement is shown in the above cited United Kingdom patent specification. The operation is the same i.e. when solenoid 106 is deenergized, clutch member 105 is decoupled from shaft 95, by virtue of a spring 111, thereby decoupling the upper and lower feed roller shaft 121, 125 from pinch-roller shaft 95; and when solenoid 106 is energized, the clutch member is coupled to the shaft, thereby coupling the upper and lower feed roller shafts 121, 125 to pinch-roller shaft 95.

The arrangement of the one-way roller clutch 93*a* between the pinch-roller toothed-pulley 91 and its shaft 95 is such that the clockwise (as viewed in FIG. 1) rotation of the motor shaft 89 driving pulley 91 will effectively rotate shaft 95 and clutch member 101, whereas the counter-clockwise rotation of the motor shaft 89 will be ineffective to rotate shaft 95 and clutch member 101. The arrangement of the one-way roller clutches 93*b* and 93*c* coupling shaft 95 to the upper and lower feed shafts 121 and 125 is such that the clockwise rotation of shaft 95 will be effective to rotate shafts 121 and 125, and their feed-rollers 71, to thereby pick-up the leading ledger in the main hopper compartment 41 and to feed it towards the pinch-rollers 97, which feed the ledger towards the accounting machine throat 37. At the same time, clutches 93*b*, 93*c* permit shafts 121 and 125, and the feed-rollers 71 connected thereto, to "run ahead" when the ledger being fed comes under the control of the more rapidly rotating pinch-rollers 97 fixed to shaft 95.

The foregoing elements, including the feed-rollers 71 and pinch-rollers 97 for feeding a ledger from the main hopper compartment 41, are substantially duplicated for feeding a ledger from the auxiliary hopper compartment 200, except that a ledger from the auxiliary compartment is fed during the counter-clockwise rotation of the motor shaft, rather than the clockwise rotation. Thus, the toothed-pulley 91 coupled to the motor shaft 89 is connected via another belt 290 to an auxiliary pinch-roller toothed pulley 291, which in turn is connected by a one-way roller clutch 293*a* (FIG. 2) to a pinch-roller shaft 295 for the axiliary hopper compartment 200. One-way clutch 293*a* couples pulley 291 to shaft 295 upon the counter-clockwise rotation of the pulley. Shaft 295 carries a plurality of pinch-rollers 297, which in combination with a number of cooperating idler-rollers 299 mounted on another flexure shaft 299' (FIG. 1), move the ledgers along branch path P1a from the auxiliary hopper compartment 200 to the accounting machine throat 37. The end of shaft 295 carries a clutch member 301 cooperable with another clutch-member 305 which is actuated by another solenoid 306, corresponding to solenoid 106 in the main feeder, controlling the coupling of shaft 295 to an upper feed-roller shaft 321 and to a lower feed-roller shaft 325.

The feed for the auxiliary hopper ledgers also includes a one-way roller clutch 293*b* (FIG. 2*b*) coupling the upper feed shaft 321 to shaft 295, and another one-way roller clutch 293*c* coupling the lower feed shaft 325 to shaft 295, for operation in the same manner as the corresponding elements in the main hopper feed system. The upper and lower feed shafts 321 and 325 carry a plurality of feed-rollers 271, the feed-rollers on shaft 325 cooperating with idler-rollers 337 on scrub shaft 329, (FIG. 1) for feeding the ledgers from the auxiliary hopper compartment 200 to the accounting machine throat 37. These rollers are effective to feed the ledger upon the counter-clockwise rotation of shaft 89, and are also able to "run ahead" when the ledger being fed comes under the control of the more rapidly rotating pinch-rollers 297 on shaft 295, as described above with respect to the corresponding elements in the feed system for the ledgers in the main hopper compartment 41.

It will thus be seen that if the motor is energized for clockwise rotation and solenoid 106 is actuated, feed shafts 121 and 125 are coupled to the drive via clutch 93*a* to feed a ledger from the main hopper compartment 41; and if the motor is energized for counter-clockwise rotation and solenoid 306 is actuated, feed shafts 321 and 325 are coupled to the drive via clutch 293*a* to feed a ledger from the auxiliary hopper compartment 200.

The drive for the ledger stacking means in the device illustrated in the drawings is substantially the same as in the above-cited U.K. patent specification. It includes an upper stack shaft 149 and a lower stack shaft 151, both shafts being provided with a plurality of fixed stack-rollers 153 with each stack-roller backed up by an idler-roller 155 mounted on their respective flexure shafts 155'. The upper and lower stack shafts 149 and 151 are driven from the motor shaft 89 via a belt coupled to a pulley 157 fixed to shaft 149, and to a pulley 159 fixed to shaft 151.

When the input shaft 89 is rotated in a counter-clockwise direction, pulleys 157 and 159 are rotated in a clockwise direction to thereby rotate the stack shafts 149 and 151 clockwise. This causes the stack-rollers 153 fixed to these shafts to move a ledger, ejected from the accounting machine 37, along the branch path indicated by arrow P2m where it engages the front surface of deflector gate 204 (assuming that the deflector gage 204 is in the full-line position illustrated in FIG. 1) and moves into the main stacker, compartment 43. If the deflector gate 204 has been actuated to the broken-line position illustrated in FIG. 1, the ledger does not move along the front surface of the deflector gate 204, but rather engages the rear surface of that gate, and is therefore deflected along the branch path indicated by arrow P2*a*, wherein it moves into the auxiliary stacker compartment 202 rather than into the main stacker compartment 43.

Figure 4:
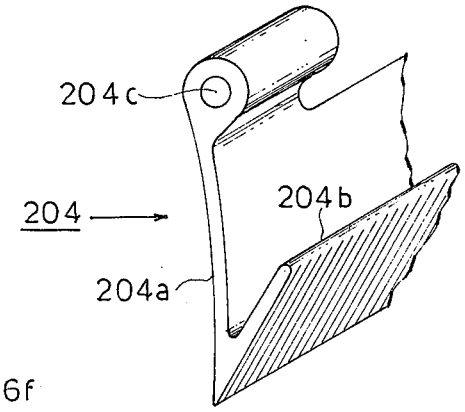
FIG. 4 is a fragmentary perspective view illustrating the deflector gate for deflecting a ledger into the main stacker compartment or the auxiliary stacker compartment.
Figure 5:
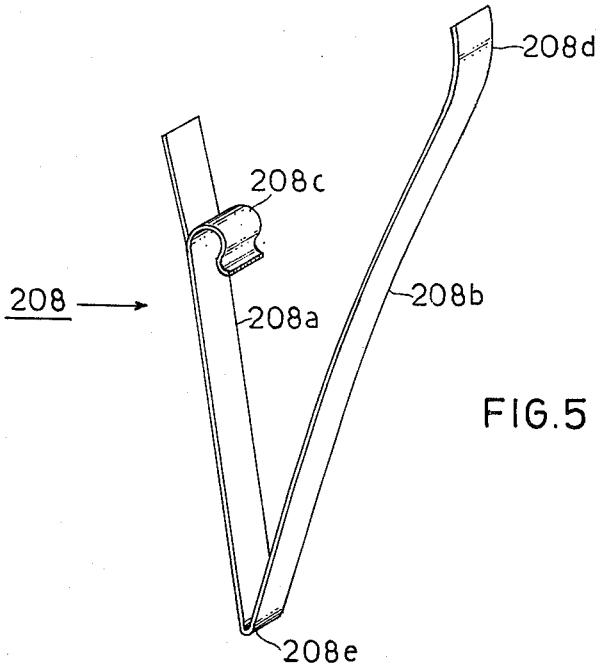
FIG. 5 is a perspective view illustrating the hold station deflector.

Deflector gate 204 is best illustrated in FIGS. 1 and 4. It includes a front leg 204*a* terminating at its lower edge in a rearwardly extending wing 204*b*. Leg 204*a* is pivotably mounted at its upper end 204*c* enabling the gate to move from a normal rear (full-lines, FIG. 1) position to an actuated forward (broken-lines) position, the position of gate 204 being controlled by a solenoid as shown at 205 in FIG. 1. As indicated above, when the gate is in the full-line position, its front surface is engaged by a ledger moving from the accounting machine, which surface deflects the ledger to branch path P2*m* between rollers 153 and 155, the latter moving the ledger into the main stacker compartment 43; whereas if the gate is moved to the broken-line position, the ledger engages the rear surface of wing 204*b*, which surface deflects the ledger to branch path P2*a* into the auxiliary stacker compartment 202.

Figure 3:
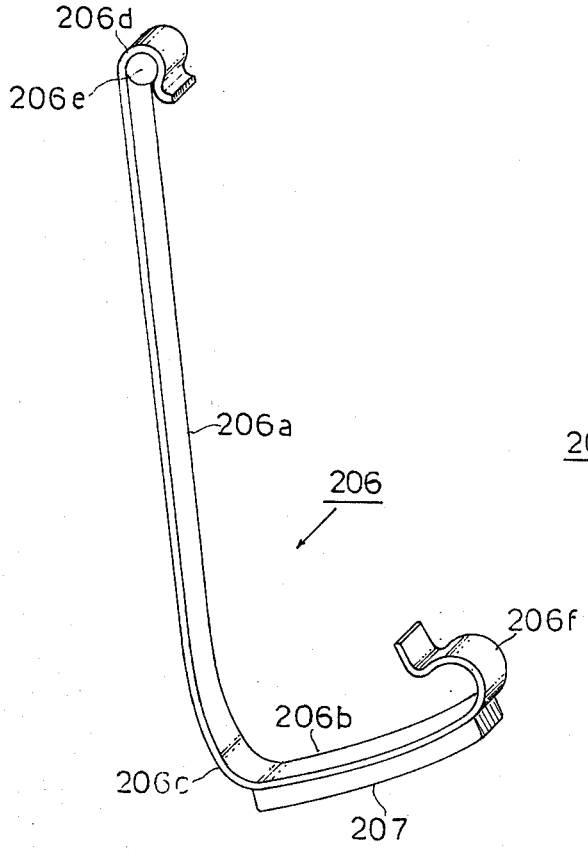
FIG. 3 is a perspective view illustrating the stacker ram.

Stacker ram 206, briefly mentioned above, is disposed within the stacker compartment 43 and acts to compact the ledgers within that compartment so as to increase the number of ledgers that can be accommodated within a limited spaced in the compartment, and thereby to increase the ledger-capacity of the device. Ram 206, as shown in FIGS. 1 and 3, is in the form of a two-legged member of approximately L-shape configuration, one leg 206*a* being substantially vertical, and the other leg 206*b* being substantially horizontal, both legs being joined by a curved juncture 206*c*. The upper end of leg 206*a* is hooked as shown at 206*d* for pivotably mounting same to a rod 206*e*. Its lower leg 206*b* terminates in a turned-in end 206*f* and includes a friction element 207 attached to its lower surface, which friction element is engageable with stack-roller 153 of the upper stack shaft 149.

As described previously and as to be described more particularly below, during a "Ledger-Feed" operation when a ledger is fed from the main hopper compartment 41 towards the accounting machine throat 37, the upper stack shaft 149 is driven counter-clockwise, thereby moving the stacker ram 206 to the broken-line position illustrated in FIG. 1 wherein its curved juncture 206*c* is brought against the stack of ledgers within the main stacker compartment 43 to compact them. On the other hand, during a "Ledger-Stack" operation when a ledger is fed from the accounting machine to one of the stacker compartments, stack rollers 153 are driven clockwise, whereby stacker ram 206 is moved to its full-line position illustrated in FIG. 1, away from the stack of ledgers within the main stacker compartment 43, thereby enabling a ledger being fed through path P2 to enter the stacker compartment. The stack of cards is compacted again during the next ledger-feed operation.

As in the feeder-stacker device of the above-cited United Kingdom Patent Specification and as mentioned above, the device illustrated in the drawings also provides a hold station for a partially processed ledger ejected from the accounting machine. During a "Ledger-Park" operation, a partially processed ledger from the accounting machine is temporarily retained or parked, and during a "Ledger-Recall" operation it is recalled back into the accounting machine for the completion of its processing. When a "Ledger-Park" operation is to be performed, motor 87 is energized to rotate counter-clockwise for a predetermined interval sufficient to cause stack rollers 153, rotating clockwise, to advance the partially processed ledger from the account machine throat 37 to an intermediate "hold" or "park" station wherein its leading edge assumes the position of line XX in FIG. 1, and its trailing edge assumes the position of line YY. The ledger is held in this station while the accounting machine is used for generating other data, after which time the ledger may be recalled by a "Park-Recall" operation from the hold station back into the accounting machine for the completion of its processing. A "Ledger-Stack" operation may then be performed, wherein the completely-processed ledger is fed from the accounting machine to either the main stacker compartment 43 or to the auxiliary stacker compartment 202, this being determined by the position of deflector gate 206 as described above.

The previously-mentioned hold station deflector 208 is also a two-legged member of approximately V-shape configuration, including a first leg 208*a*, and a longer second leg 208*b*. Leg 208*a* is pivotably mounted at its upper end, as shown at 208*c*. The free end of leg 208*b* includes an extension 208*d* extending above pivotal mounting 208*c* and disposed in the path of movement of the ledger (indicated by arrow P2, FIG. 1) when moving from the accounting machine throat 37 to one of the stacker compartments 43 or 202. In the normal position of deflector 208, as shown by the full lines in FIG. 1, its lower tip 208*e* joining the two legs is disposed at the front side (left side in FIG. 1) of the center line CL of the path P2 taken by the ledger as it moves from the accounting machine throat 37 back into the feeder stacker device, so that the ledger engages the rear surface of leg 208*b* which directs it along path P2 between the two guide members 49 and 85. As the trailing edge engages the outer extension 208*d* of the deflector leg 208*b*, it pivots the deflector (counterclockwise in FIG. 1) about pivot 208*c* to the broken-line position illustrated, wherein the bottom tip 208*e* of the deflector passes to the rear side (right side in FIG. 1) of the path P2 center line CL.

Thus, if a ledger comes to rest in the hold station, between lines XX and YY as described above, the hold station deflector 208 is retained in its actuated position as shown by the broken-lines in FIG. 1. When the deflector is in this actuated position, another ledger that is fed into the accounting machine and ejected therefrom will engage the front surface of the leg 208*a* of the deflector, rather than the rear surface of leg 208*b*. It will therefore be blocked from passing into path P2 of the feeder stacker, but rather will be directed to the front of the feeder stacker for manual removal by the operator.

This arrangement, including the hold station deflector 208, enables, the operator, after partially processing a ledger in the accounting machine and then temporarily holding it in the hold station, to manually insert another ledger (via the path indicated by arrow P3, FIG. 1) for processing by the accounting machine, which manually-fed ledger will then be ejected from the accounting machine back to the operator via path P3 but in the opposite direction. The ledger in the hold station can then be reintroduced back into the accounting machine for the completion of its processing, after which it will be ejected therefrom and be passed via path P2 to the main stacker compartment 43 or to the auxiliary stacker compartment 202, depending upon the position of deflector gate 204.

The feeder stacker device illustrated in the drawings will be better understood by a brief description of each one of the operations mentioned above with reference to the diagrams of FIGS. 6*a* and 6*b*.

First, the swingable frame, including hopper walls 210, 45 and side walls 214, is pivoted with shaft 55 to its latched position as illustrated in FIG. 1, wherein the lower edge of wall 210 is engaged by latch 216. In this position, the main hopper compartment 41 and the auxiliary hopper compartment 200 may be loaded with their respective ledgers (MHL, AHL, FIG. 1*a*), wall 210 acting as a guide face for the inserted auxiliary ledgers AHL, and wall 45 acting as a guide face for the inserted main ledgers MHL. When the feeder is to be used, latch 216 is released, whereupon the frame swings forwardly on shaft 55 under the influence of spring 65 to the position illustrated in FIG. 1*a*. This causes wall 212 to press the ledgers AHL in the auxiliary compartment 200 against their respective feed-rollers 271 and causes wall 45 to press the ledgers MHL in the main compartment 41 against their respective feed-rollers 71.

Figure 6A:
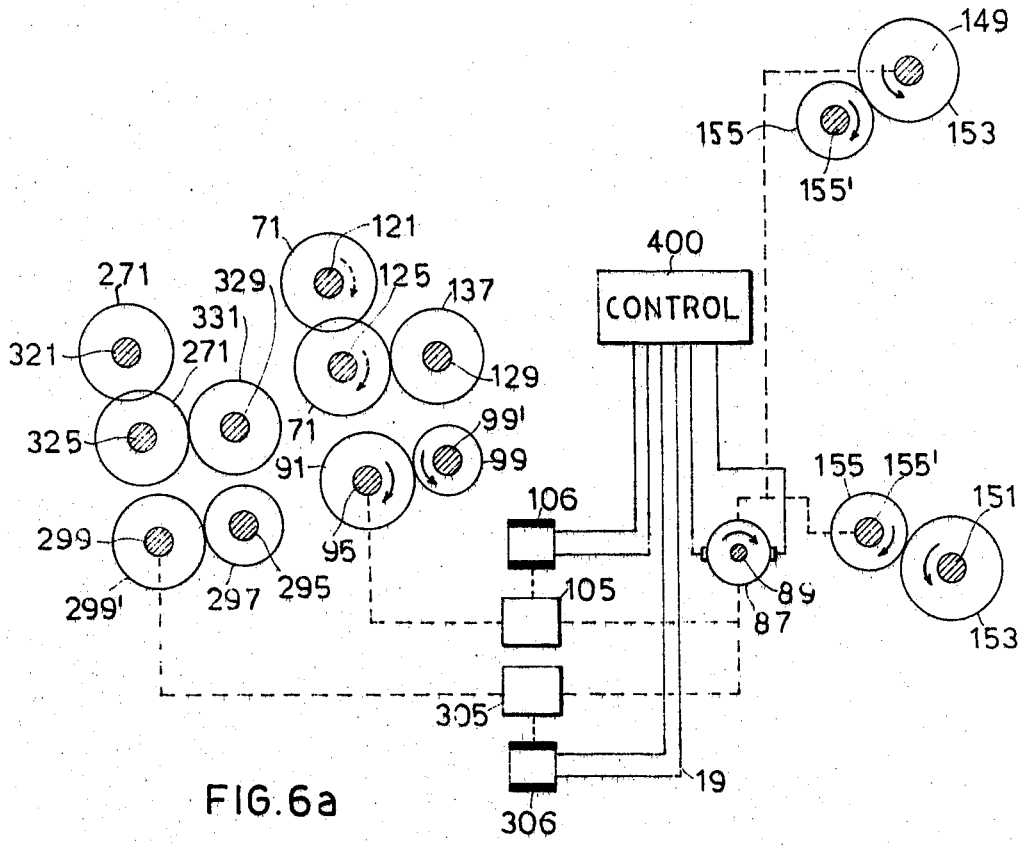
FIG. 6*a* illustrates the operation of the sheet feeding and stacking drives during a Main Ledger Feed or Park-Recall operation.

A Main-Ledger-Feed operation is initiated by transmitting a signal to the reversible motor 87 to rotate its shaft 89 in a clockwise direction as viewed in FIGS. 1 and 6*a*, and simultaneously energizing solenoid 106. Motor shaft 89 rotating clockwise rotates pinch-roller shaft 95 clockwise as shown in FIG. 6*a*. When solenoid 106 is actuated, the upper and lower drive shafts 121 and 125, respectively, are coupled to pinch-roller shaft 95, so that feed-rollers 71 are rotated in a clockwise direction to pick up the leading ledger in the main hopper compartment 41 and to feed it via branch P1m of path P1 to the accounting machine throat 37.

At the same time, the upper and lower stack-rollers 153 on the upper and lower stack shafts 149 and 151, respectively, are driven in a counter-clockwise direction. The upper stack-roller 153 on shaft 149, being in contact with friction element 207 on the lower surface of leg 206*b* of the stacker ram 206, is driven against the stack of ledgers in the main stacker compartment 43 (i.e. leftwardly in FIG. 1) to thereby compact the stack of ledgers therein.

Figure 6B:
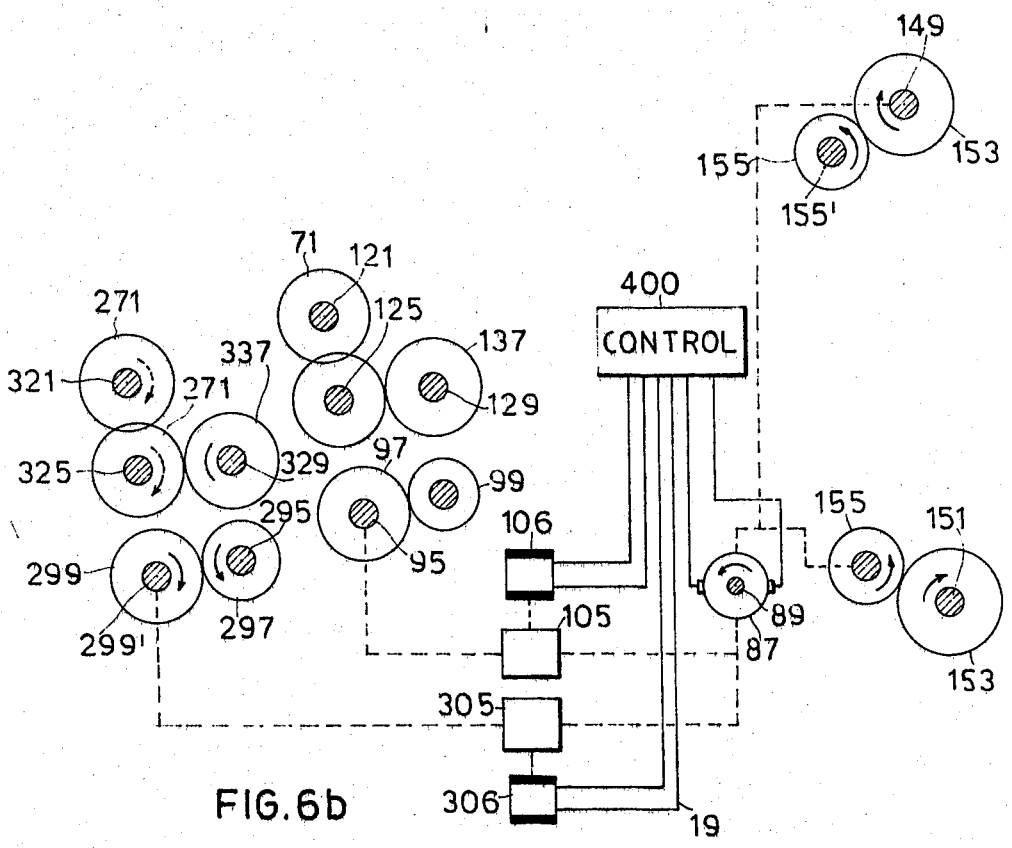
FIG. 6*b* illustrates the operation of the sheet feeding and stacking drives during a Ledger Stack, Auxiliary Ledger Feed, or Ledger-Park operation.

An Auxiliary Ledger-Feed operation is initiated by applying a signal to motor 87 to rotate its shaft 89 in a counter-clockwise direction as viewed in FIGS. 1 and 6*b*, and simultaneously energizing solenoid 306. Motor shaft rotating counter-clockwise rotates shaft 95 counter-clockwise, and shaft 295 clockwise. When solenoid 306 is actuated, instead of solenoid 106, shaft 295 is coupled to the upper and lower drive shafts 321, 325, so that drive-rollers 271 of the auxiliary ledger drive are rotated in a clockwise direction to pick up the leading ledger in the auxiliary hopper compartment 200, and to feed it via branch P1*a* of path P1 to the accounting machine throat.

A ledger-Stack operation (FIG. 6*b*) is initiated by transmitting a signal to reversible motor 87 to rotate its shaft 89 in a counter-clockwise direction, while at the same time neither solenoid 106 nor 306 is energized. Rotating motor shaft 89 in a counter-clockwise direction causes the upper and lower stack shafts 149 and 151 to be rotated in a clockwise direction, and the pinch-roller pulley 91 to be rotated in a counter-clockwise direction. Counter-clockwise rotation of the latter pulley, as described above, is ineffective to rotate the pinch-roller shaft 95 in view of the one-way roller clutch 93*a* (FIG. 2), and therefore the feeding means for feeding a ledger from the main hopper compartment 41 is ineffective.

Clockwise rotation of the lower stack shaft 151 is effective to transport a ledger, ejected from the accounting machine throat 37 via path P2, until the leading edge arrives at the lower tip of deflector gate 204.

The position of deflector gate 204 determines whether the ledger will be fed into the main stacker compartment 43 or into the auxiliary stacker compartment 202. As mentioned above, gate 204 is controlled by solenoid 205 (FIG. 1) such that in one position (namely the full-line position, in FIG. 1) of the gate, the ledger engages the front face of its leg 204*a* and is deflected to pass between the stack-rollers 153 on the upper stack shaft 149, and the associated idler-rollers 155, whereby the ledger moves via branch P2*m* into the main stacker compartment 43. On the other hand, if gate 204 has been actuated by solenoid 205 so as to move to the broken line position illustrated in FIG. 1, the ledger engages the rear surface of leg 204*b* of the gate and moves along branch P2*a* into the auxiliary stacker compartment 202.

A Ledger-Park (or Ledger-Hold) operation is initiated by the transmission of a signal to reversible motor 87 to rotate its shaft 89 in the counter-clockwise direction, as in a Ledger-Stack operation (FIG. 6*b*), except that the signal actuates the motor only for a predetermined interval insufficient to transport the ledger to either stacker compartment, but sufficient only to move it to the "hold" station wherein its leading and trailing edges come to rest at the positions of lines XX and YY, respectively, in FIG. 1. The accounting machine may then be used for additional data processing operations, while the partially processed ledger is temporarily retained in the hold station.

A Park-Recall operation is initiated by the transmission of a signal to motor 87 causing its shaft 89 to rotate in a clockwise direction as in a Ledger-Feed operation (FIG. 6*a*). This will cause the stack-rollers 153 on the upper and lower stack shafts 149 and 151, respectively, to rotate in a counterclockwise direction, causing the ledger in the hold station to be fed back via path P2 into the accounting machine throat 37 for the completion of its processing by the accounting machine. When this is completed, A Ledger-Stack operation may then be performed, in which the completely processed ledger is transmitted to the main stacker compartment 43 or auxiliary stacker compartment 202 in the manner described above.

While a Park-Recall operation will cause pinch-rollers 95 and 295 also to rotate, in a counter-clockwise direction, their respective feed-rollers 71 and 271 will remain idle because neither solenoid 106 nor solenoid 306 was energized, and therefore the respective feed shafts 121, 125 and 321, 325 were not coupled to their respective pinch-roller shafts 95 and 295. Accordingly, during a Park-Recall operation, a ledger will not be fed from either the main hopper compartment 41 or the auxiliary hopper compartment 200.

The operation of the hold station deflector 208 was briefly described above. Normally, this deflector is in the full-line position illustrated in FIG. 1, where in its lower tip 208*e* is forwardly (leftwardly in FIG. 1) of the center line CL representing the path of travel of a ledger from the accounting machine throat 37 to the feeder-stacker device. Thus, a ledger ejected from the accounting machine will engage the rear surface of leg 208*b* of the deflector forcing same to travel along path P2 to one of the stacker compartments, or to the hold station, depending upon the specific operation. However, whenever a ledger is in the hold station (between lines XX and YY as described above), its trailing edge engages extension 208*d* of the hold station deflector leg 208*b*, causing the deflector to be pivoted to the broken line position of FIG. 1 wherein its lower tip 208*e* moves rearwardly (right-wardly in FIG. 1) of center line CL. In this position of the deflector, any ledger ejected from the accounting machine throat 37 will engage the front surface of leg 208*a* of the deflector, causing same to move, not via path P2 into the stacker, but rather to move along the front of the device where it is manually received by the operator. This arrangement enables the operator, even when a ledger is in the hold station, to manually insert another ledger via path P3 into the accounting machine throat 37 for processing by the accounting machine, after which time the ledger will be automatically ejected back to the operator via path P3, rather than being fed into the ledger stacker via path P2.

While the invention has been described with respect to a particular embodiment, it will be appreciated that many variations, modifications, and other applications thereof may be made.

What is claimed is:

1. A sheet handling device for handling sheets to be processed by a data processing machine, comprising: a right and left side frame member; a main hopper compartment disposed between said frame members for receiving sheets to be processed; a main stacker compartment disposed between said frame members for receiving sheets after their processing; sheet feeding means for feeding the sheets from the main hopper compartment through a first path leading to the data processing machine; sheet stacking means for moving the sheets, after their processing by the data processing machine, through a second path leading from the data processing machine to the stacker compartment; an auxiliary hopper compartment disposed between said frame members for receiving additional sheets to be processed; auxiliary feed means for feeding sheets from the auxiliary hopper compartment through said first path to the data processing machine; a stacker ram pivotally mounted to said frame members in the main stacker compartment; ram drive means for moving the stacker ram away from the stack of sheets in the main stacker compartment during the operation of the stacking means, and against said stack to compact same during the operation of the sheet feeding means; and control means for selectively actuating said sheet feeding means or said auxiliary feeding means to feed a sheet from the main hopper compartment or the auxiliary hopper compartment through the first path to the data processing machine for processing thereof.

2. A sheet handling device according to claim 1 further including an auxiliary stacker compartment disposed between said frame members; a gate in said second path; and means for actuating said gate to direct the sheets either into the main stacker compartment or into the auxiliary stacker compartment.

3. A sheet handling device for handling sheets to be processed by a data processing machine, comprising: a right and left side frame member: a main hopper compartment disposed between said frame members for receiving sheets to be processed; a main stacker compartment disposed between said frame members for receiving sheets after their processing; sheet feeding means for feeding the sheets from the main hopper compartment through a first path leading to the data processing machine; sheet stacking means for moving the sheets, after their processing by the data processing machine, through a second path leading from the data processing machine to the stacker compartment; a stacker ram pivotally mounted to said frame members in the main stacker compartment; and ram drive means for moving the stacker ram away from the stack of sheets in the main stacker compartment during the operation of the stacking means, and against said stack to compact same during the operation of the sheet feeding means.

4. A sheet handling device according to either claim 3, wherein said stacker ram drive means includes a reversibly-driven roller, said stacker ram comprising an arm pivotably mounted at one end and frictionally engaging at its opposite end said reversibly-driven roller, said latter roller being driven in one direction to move the stacker ram away from the stack of sheets in the main stacker compartment, or in the opposite direction to move the stacker ram towards the stack of sheets in the main stacker compartment to compact same.

5. A sheet handling device according to claim 4, wherein the upper end of the stacker ram is pivotably mounted and includes a curved juncture with the lower end, the latter end frictionally engaging said reversibly-driven roller.

6. A sheet handling device according to claim 4, wherein said stacker ram includes a two-legged member of approximately L-shape configuration, one leg being substantially parallel to the stack of sheets and pivotably mounted at its upper end, the other leg being substantially at right angles to the stack of sheets and having a lower surface frictionally engaging said reversibly-driven roller, the juncture between the two legs being curved and engaging the stack of sheets to compact same when driven by the reversibly-driven roller.

7. A sheet handling device according to claim 6, wherein said reversibly-driven roller is a part of the sheet stacking means.

8. A sheet handling device according to claim 3 wherein said second path includes a hold station disposed between said frame member for temporarily holding processed sheets being fed from the data processing machine, said control means also including means for selectively controlling said sheet stacking means to terminate the operation thereof when the processed card has reached the hold station.

9. A sheet handling device according to claim 8, further including substantially V-shaped hold station deflector in said second path, said deflector being actuated when a sheet is in the hold station to prevent another sheet leaving the processing machine from passing into said second path.

10. A sheet handling device for handling sheets to be processed by a data processing machine, comprising: a right and left side frame member; a main hopper compartment disposed between said frame members for receiving sheets to be processed; a main stacker compartment disposed between said frame members for receiving sheets after their processing; sheet feeding means for feeding sheets from the main hopper compartment through a first path leading to the data processing machine; sheet stacking means for moving the sheets after their processing by the data processing machine, through a second path leading from the data processing machine to the stacker compartment; said second path including a hold station disposed between said frame members for temporarily holding processed sheets being fed from the data processing machine; a substantially V-shaped pivotably mounted hold station deflector in said second path said deflector being pivotably actuated by a sheet moving into the hold station wherein said sheet engages one surface of said V-shaped deflector causing said deflector to pivot into a blocking position to prevent another sheet leaving the data processing machine from passing into said second path; and control means for selectively controlling said sheet stacking means to terminate the operation thereof when the process card has reached the hold station.

11. A sheet handling device according to claim 9, wherein said hold station deflector comprises a two-legged member of approximately V-shape configuration, the member being pivotably mounted at the upper end of one leg, the upper end of the other leg of the member being engaged by a sheet when in the hold station to pivot the deflector member so that the lower face of the juncture between the two legs is moved from a normal position at one side of the axis of movement of the sheet from the data processing machine to said second path permitting the sheet to move into said second path, to a blocking position at the other side of the axis of movement of the sheet from the data processing machine to said second path blocking the sheet from moving into said second path.

* * * * *